US006822152B2

(12) United States Patent
Yamada et al.

(10) Patent No.: US 6,822,152 B2
(45) Date of Patent: Nov. 23, 2004

(54) AUDIO SIGNAL PROCESSING APPARATUS

(75) Inventors: Youichi Yamada, Saitama-ken (JP); Takeaki Funada, Saitama-ken (JP); Hiroyuki Isobe, Saitama-ken (JP); Keitaro Kaburagi, Saitama-ken (JP); Naomi Amemiya, Saitama-ken (JP); Gen Inoshita, Tokyo (JP); Ko Atsumi, Tokyo (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/359,793

(22) Filed: Jul. 26, 1999

(65) Prior Publication Data

US 2001/0042434 A1 Nov. 22, 2001

(30) Foreign Application Priority Data

Jul. 31, 1998 (JP) ..... 10-217982

(51) Int. Cl.[7] ..... G09D 15/00

(52) U.S. Cl. ..... 84/484; 84/652; 84/668; 84/DIG. 12

(58) Field of Search ..... 84/611–612, 635–636, 84/651–652, 667–668, 484, DIG. 12; 381/119, 58

(56) References Cited

U.S. PATENT DOCUMENTS

| | | | | | |
|---|---|---|---|---|---|
| 4,733,593 | A | * | 3/1988 | Rothbart | 84/484 |
| 5,614,687 | A | * | 3/1997 | Yamada et al. | 84/662 |
| 5,734,731 | A | * | 3/1998 | Marx | 381/119 |
| 5,850,048 | A | * | 12/1998 | Ruf | 84/484 |
| 6,175,632 | B1 | * | 1/2001 | Marx | 381/56 |

* cited by examiner

*Primary Examiner*—Marion T. Fletcher
(74) *Attorney, Agent, or Firm*—Arent Fox, PLLC

(57) ABSTRACT

An audio signal processing apparatus for changing a tempo of an input audio signal is disclosed. The apparatus includes a magnification designator capable of designating a plurality of different magnifications. A device is capable of automatically detecting a beat(s) per minute, BPM, or the audio input signal. The device may also detect a beat period of the input audio signal. The device also changes the BPM or beat period in accordance with a magnification designated by the magnification designator. Further, the device changes the tempo of the audio signal in accordance with the changed BPM and the changed beat period.

50 Claims, 4 Drawing Sheets

AUDIO SIGNAL PROCESSING APPARATUS

BACKGROUND OF THE INVENTION

The present invention relates to an audio signal processing apparatus, in particular to an audio signal processing apparatus capable of changing the tempo of a musical sound, thereby making it possible to produce various musical sounds having different tones.

Traditionally, there has been known an audio signal processing apparatus called EFFECTOR which can process an audio signal to produce a rhythmical music or a slow tempo music by changing the tempo of an original musical sound. If the audio signal processing apparatus is used in a discotheque, a human operator can operate the apparatus to continuously provide customers (people dancing disco in the discotheque) with more satisfactory musical sound. Further, if the original tempo of a musical sound is changed, it is possible to produce a musical sound having new musical feelings from time to time, to thereby more effectively satisfy the customers dancing in the discotheque.

A conventional audio signal processing apparatus has a tempo adjusting dial which is allowed to be operated by a human operator to adjust the tempo of a musical sound in accordance with his or her own musical feelings.

However, with the above conventional audio signal processing apparatus, since it is necessary for a human operator to adjust the tempo of a musical sound in accordance with his or her own musical feelings, it is difficult for him or her to continuously change or adjust the tempo of a musical sound for a long time, hence making it difficult to produce a truly satisfactory musical sound. Further, since the tempo adjustment is made all by manual operation, a comparatively long time is required until a desired tempo is obtained, thus an operation efficiency is relatively low.

SUMMARY OF THE INVENTION

It is an object of the present invention to provide an improved audio signal processing apparatus capable of automatically changing the tempo of a musical sound, thereby ensuring an improved operation efficiency of said audio signal processing apparatus, so as to solve the above-mentioned problems peculiar to the above-discussed prior art.

According to the present invention, there is provided an audio signal processing apparatus capable of changing the tempo of an input audio signal, said apparatus comprising: magnification designating means capable of designating a plurality of different magnifications; means capable of automatically detecting a BPM (Beats Per Minute) or a beat period of the input audio signal, changing said BPM or said beat period in accordance with a magnification designated by the magnification designating means, changing the tempo of the audio signal in accordance with the changed BPM and the changed beat period.

In one aspect of the present invention, manual designating means is provided for designating any optional value serving as a BPM and a beat period.

In another aspect of the present invention, fine adjustment means is provided to effect a fine adjustment on a BPM and a beat period.

In a further aspect of the present invention, indicators are provided to indicate a BPM and a beat period.

In a still further aspect of the present invention, a mixer is provided such that an audio signal generated by changing the tempo of said audio signal may be mixed with said input audio signal, thereby producing a newly formed audio signal.

In one more aspect of the present invention, mixing ratio adjusting means is provided to adjust a mixing ratio when an audio signal generated by changing the tempo of said audio signal is mixed with said input audio signal, thereby producing a newly formed audio signal.

The above objects and features of the present invention will become better understood from the following description with reference to the accompanying drawings.

DETAILED DESCRIPTION OF THE PREFERRED EMBODIMENTS

Figure 1:
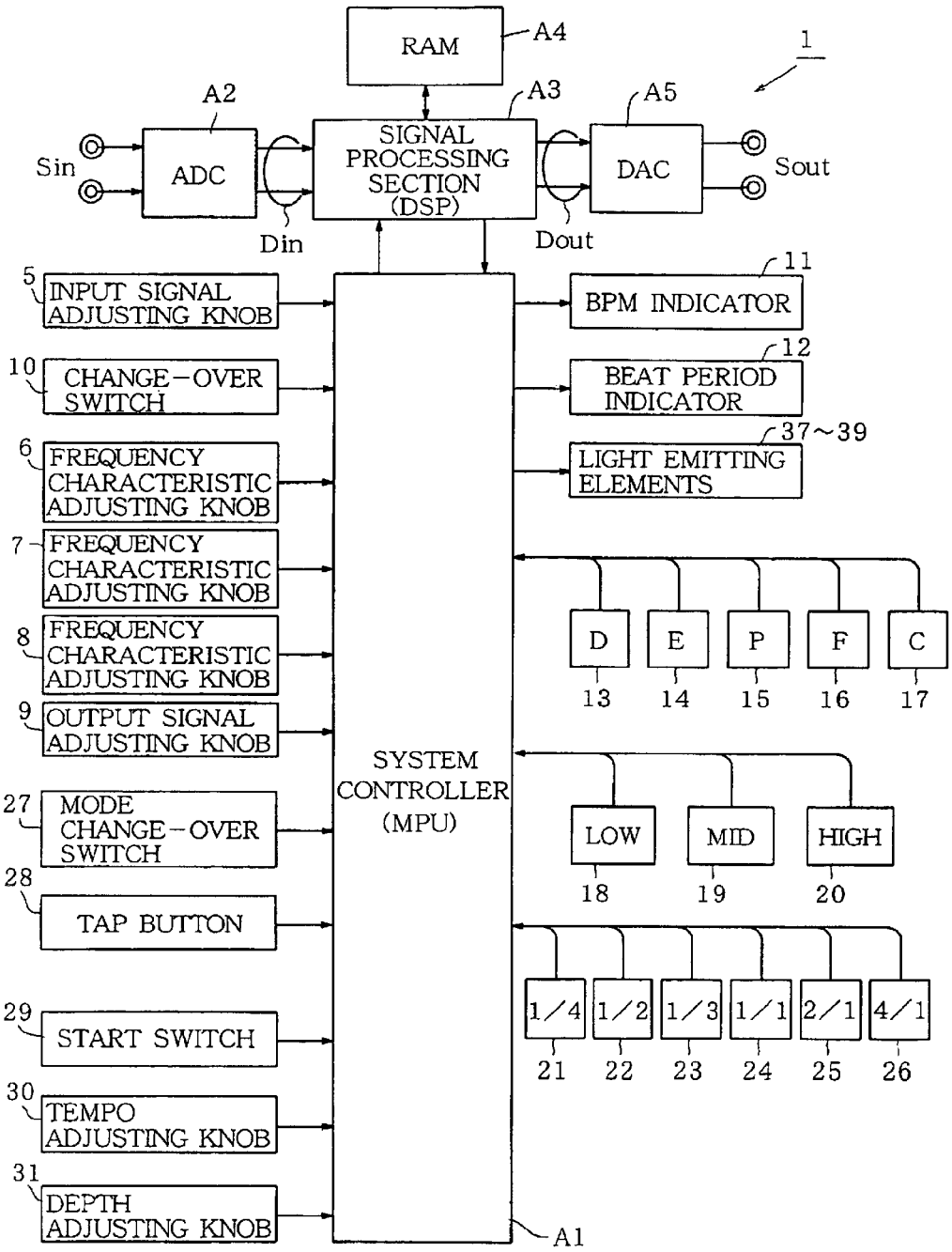
FIG. 1 is a block diagram indicating an important portion of a circuit contained in an audio signal processing apparatus made according to the present invention.

Referring to FIG. 1 showing an embodiment of the present invention, an audio signal processing apparatus 1 comprises a system controller A1 for controlling all operations of the apparatus 1, an A/D converter A2 for changing analogue stereo audio signal Sin (fed from outside) to digital data Din, a signal processing section A3 capable of processing various data for various musical performances, a storing section A4 for storing various data while the signal processing section 3 is in its operation, a D/A converter A5 for changing the digital data Dout fed from the signal processing section A3 to analogue audio signal Sout.

Various operating and indicating means 5–39, which will be described in detail later, are connected with the system controller A1.

The system controller 1 includes an MPU (microprocessor unit) capable of controlling all operations of the audio signal processing apparatus 1 in accordance with a system program prepared in advance. Once a human operator operates any of the above operating means, such an operation will be detected by the system controller A1 so as to control the signal processing section A3 and to control the above indicator means.

The signal processing section A3 has a DSP (digital signal processor) which operates in accordance with the commands from the system controller 1 to process the digital data Din fed from the A/D converter A2.

Figure 2:
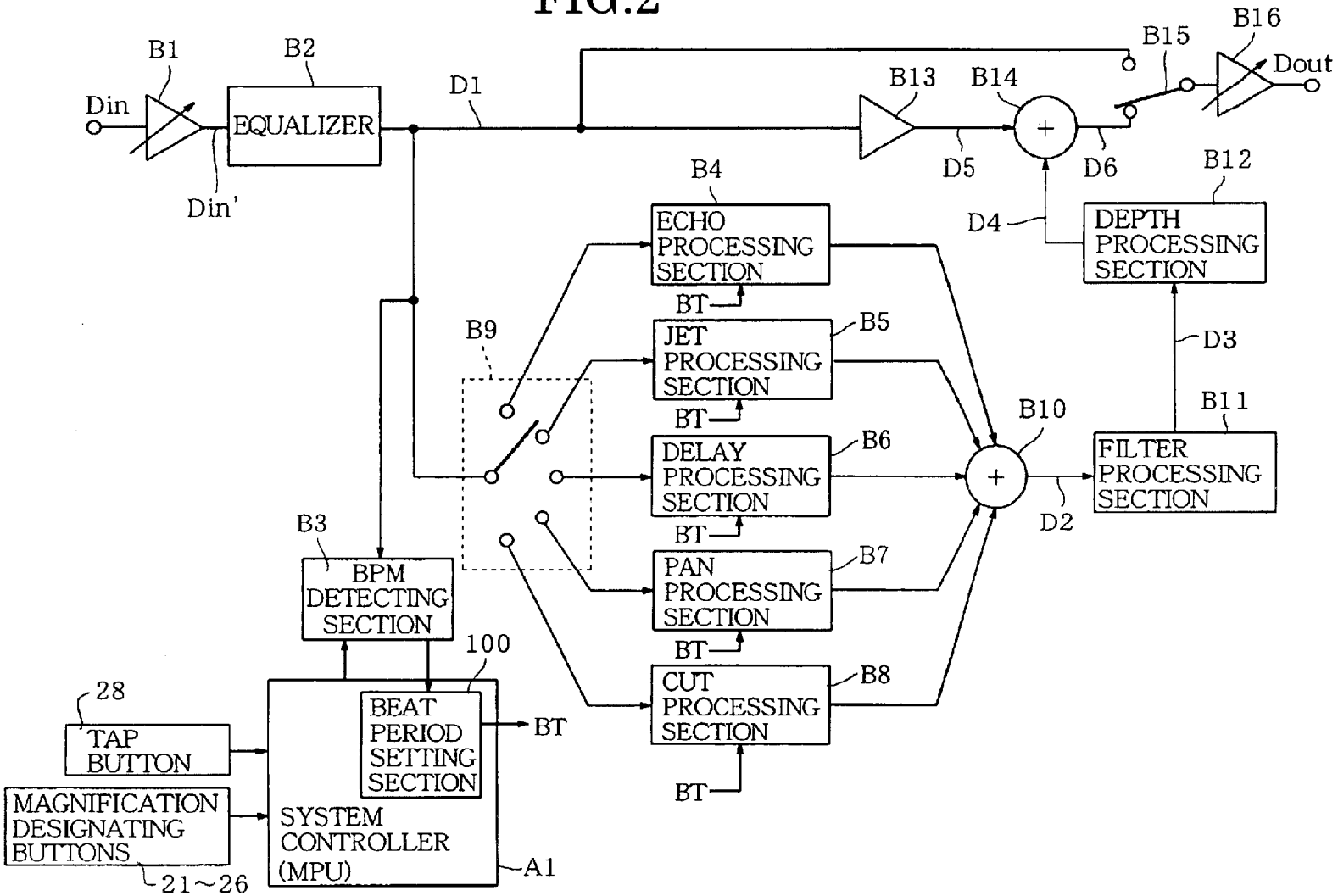
FIG. 2 is a block diagram indicating an equivalent circuit for a digital signal processor contained in the audio signal processing apparatus of the present invention.

With the use of the DSP, an equivalent circuit can be formed as shown in FIG. 2.

Referring to FIG. 2, the equivalent circuit includes a variable amplifier B1 for adjusting an input level of digital data Din fed from the A/D converter A2, and an equalizer B2 capable of providing an equalizing function by variably adjusting the frequency characteristic of digital data Din' fed from the variable amplifier B1, a BPM measuring section B3 for measuring BPM (Beats Per Minute) of the digital data D1 fed from the equalizer B2, an ECHO processing section B4, a JET processing section B5, a DELAY processing section B6, a PAN processing section B7, a CUT processing section B8.

A change-over section B9 is provided to perform a change-over between the equalizer B2 on one hand and any one of processing sections B4–B8 on the other.

Further, the equivalent circuit includes an adder circuit 10 for adding and passing various data fed from the various processing sections B4–B8, a filter circuit B11 for selecting a certain frequency component from digital data D2 produced in the adder circuit B10, a depth processing section B12 for effecting a depth treatment on the digital data D3 fed from the filter B11.

Moreover, the equivalent circuit includes an amplifier B13 for amplifying the digital data D1 fed from the equalizer B2, an adder circuit B14 for adding together the digital data D4 fed from the depth processing section B12 and the digital data D5 fed from the amplifier 13, a change-over section B15 for performing a change-over between an output of the digital data D1 and an output of digital data D6 (fed from the adder B14). A variable amplifier B16 is used to amplify the digital data from the change-over section B15, so as to produce digital data Dout which is then fed to the D/A converter A5.

Figure 3:
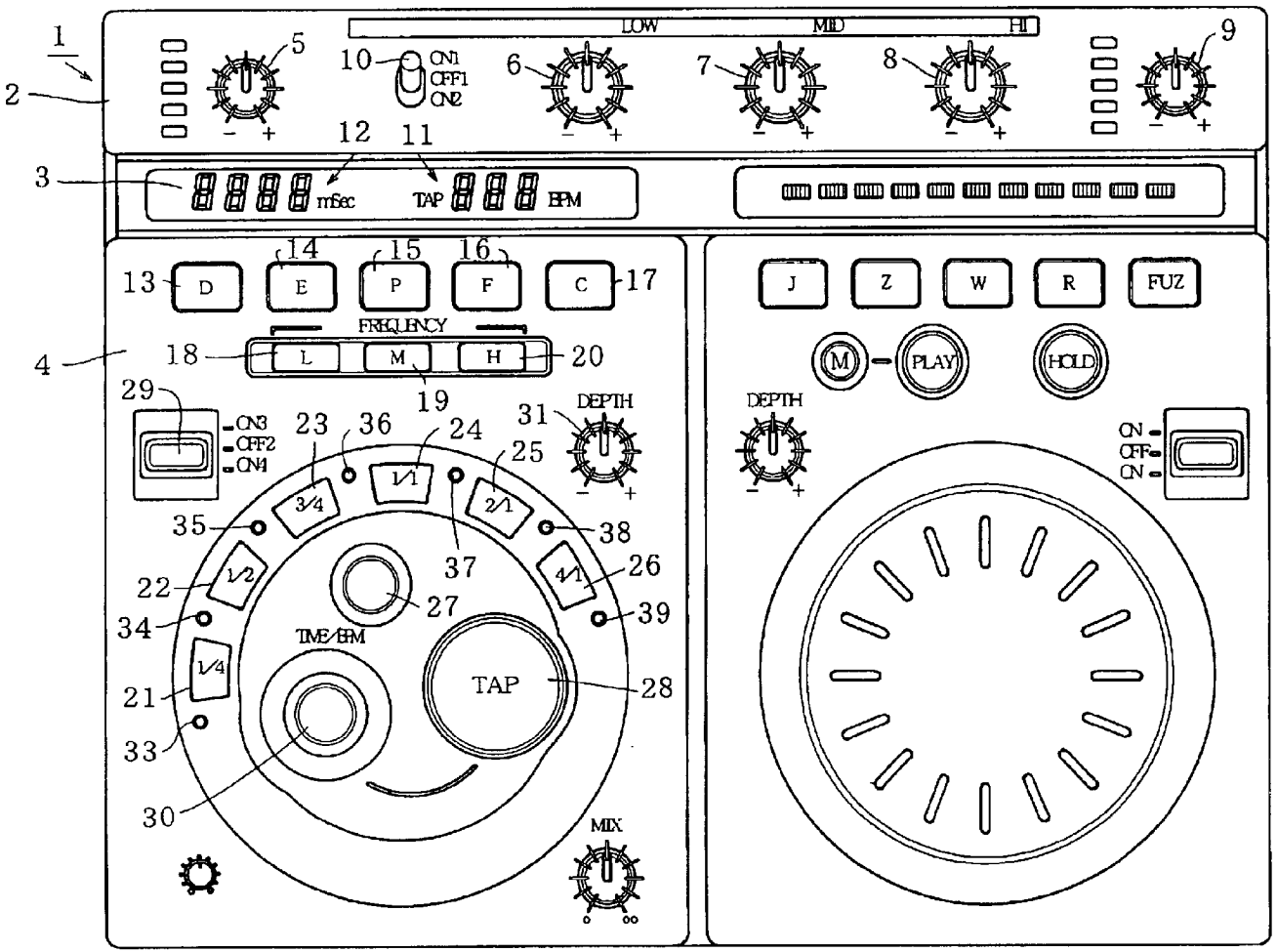
FIG. 3 is a plane view indicating an operating panel of the audio signal processing apparatus of the present invention.

As shown in FIG. 3, various operating and indicating means 5–39 are provided on an operating panel of the audio signal processing apparatus 1, with the panel being divided into an equalizer operating section 2, an indicating section 3 and an operating section 4.

Referring again to FIG. 3, the equalizer operating section 2 includes an input signal adjusting knob 5, frequency characteristic adjusting knobs 6, 7, 8, an output signal adjusting knob 9, and a change-over switch 10.

The input signal adjusting knob 5 is so formed such that once it is rotated, the rotating amount may be detected by the system controller A1 which then gives a command to the variable amplifier B1, thereby causing the amplifier B1 to adjust the level of input digital data Din in accordance with the rotating amount.

Similarly, each of the frequency characteristic adjusting knobs 6, 7, 8 is so formed that once it is rotated, the rotating amount may be detected by the system controller A1 which then gives a command to the equalizer B2, thereby causing the equalizer B2 to adjust the frequency characteristic of digital data Din' fed from the amplifier B1 in accordance with a rotating amount.

In more detail, when the adjusting knob 6 is rotated, the frequency characteristic of a low band frequency component of digital data Din' is adjusted. When the adjusting knob 7 is rotated, the frequency characteristic of a middle band frequency component of digital data Din' is adjusted. When the adjusting knob 8 is rotated, the frequency characteristic of a high band frequency component of digital data Din' is adjusted.

Further, the output signal adjusting knob 9 is so formed that once it is rotated, the rotating amount may be detected by the system controller A1 which then gives a command to the variable amplifier B16, thereby causing the amplifier B16 to adjust the level of output digital data Dout in accordance with a rotating amount.

The change-over switch 10 is provided to effect a change-over between condition a in which the frequency characteristics set by the adjusting knobs 6, 7 and 8 may be used in digital data Din' and condition b in which the condition a is cancelled.

When the change-over switch 10 is set at a position OFF1, this position will be detected by the system controller A1, so that the equalizer B2 will stop adjusting the frequency characteristic of digital data Din', thus the digital data Din' will be transmitted (without being processed) in its original state (data D1).

When the change-over switch 10 is set at a position ON1, a frequency characteristic adjusting effect is continued. On the other hand, when the change-over switch 10 is set at a position ON2, a frequency characteristic adjusting effect is continued only during an operation while the switch 10 is being set to the position ON2. Once a human operator's hand leaves the switch 10, the switch 10 will turn back to the position OFF1 due to its self reaction force, thus cancelling the above condition a.

In this way, by operating the frequency characteristic adjusting knobs 6, 7, 8 and the change-over switch 10, it is possible to change the frequency characteristic of a musical sound in a desired manner.

Referring again to FIG. 3, the indicator section 3 has a BPM indicator 11 for indicating BPM (Beats Per Minute) in three digits, and a beat period indicator 12 for indicating a time period for one beat $T_{BPM}$ (hereinafter referred to as beat period) using a unit of millisecond (mSec).

On the operating section 4, there are provided operating buttons 13–28, a snap switch 29, rotatory knobs 30 and 31, a plurality of light emitting elements 33–39.

When the operating buttons 13 is operated to be set in its ON state, this operation will be detected by the system controller A1, so that the change-over switch B9 is caused to contact the DELAY processing section B6, thereby starting the operation of the DELAY processing section B6. The DELAY processing section B6 operates to delay the digital data D1 by a predetermined time. An output digital data from the DELAY processing section B6 and non-delayed digital data D5 are added together in an adder 14, thereby obtaining a digital data Dout producing a delay performance effect.

When the operating buttons 14 is operated to be set in this ON state, this operation will be detected by the system controller A1, so that the change-over switch B9 is caused to contact the ECHO processing section B4, thereby starting the operation of the ECHO processing section B4 which performs a phase modulation and a frequency modulation on the digital data 1, thereby obtaining digital data Dout producing an ECHO performance effect.

When the operating buttons 15 is operated to be set in its ON state, this operation will be detected by the system controller A1, so that the change-over switch B9 is caused to contact the PAN processing section B7, thereby starting the operation of the PAN processing section B7. The PAN processing section B7 operates to process the digital data D1 to alternatively produce right stereo data and left stereo data (contained in the digital data D1) in synchronism with the beat Period $T_{BPM}$, thereby obtaining a digital data Dout capable of alternatively causing right and left speakers to produce musical sound.

When the operating buttons 16 is operated to be set in its ON state, this operation will be detected by the system controller A1, so that the change-over switch B9 is caused to contact the JET processing section B5, thereby starting the operation of the JET processing section B5. In this way, the JET processing section B5 operates to delay the phase of the digital data D1 so as to produce a delayed digital data D1'. Then, the delayed digital data D1' and the original digital data D1 are added together in the adder 14, thereby obtaining digital data Dout capable of producing a JET sound (which sounds like a jet airplane).

When the operating buttons 17 is operated to be set in its ON state, this operation will be detected by the system controller A1, so that the change-over switch B9 is caused to contact the CUT processing section B8, thereby starting the operation of the CUT processing section B8. In this way, the CUT processing section B8 operates to prevent the digital data D1 from being fed to the adder circuit 8, thereby obtaining a shut-off effect for not allowing any of the speakers to produce musical sound.

The operating buttons 18, 19, 20 are provided to select different frequency bands to pass through the filter circuit B11. Namely, when the operating button 18 is pushed ON, the filter circuit B11 enables the passing of only a predetermined low frequency component contained in the digital data D2 fed from the adder circuit B10. When the operating button 19 is pushed ON, the filter circuit B11 enables the passing of only a predetermined middle frequency component contained in the digital data D2. When the operating button 20 is pushed ON, the filter circuit B11 enables the passing of only a predetermined high frequency component contained in the digital data D2.

In this way, by operating the buttons 18, 19 and 20, it is possible to perform a change-over to select a desired frequency component from the digital data D2, thereby making it sure to produce various musical sounds having different tones.

On the other hand, when the adjusting knob 31 is rotated, the depth processing section B12 (for changing the extent of one performance effect) operates to adjust the phase of the digital data D3 fed from the filter B11, so as to produce digital data D4 whose phase has been advanced or delayed in accordance with a rotating amount of the adjusting knob 31. This digital data D4 is intermittently inserted into the digital data D5 fed from the equalizer B2 and amplified by the amplifier B13, thereby changing the extent of a performance effect at any time in accordance with various different requirements.

A start switch 29 is provided to control the operation of the change-over switch B15, thereby performing a change-over between a production of a musical sound processed in the above treatment and a production of a musical sound not processed.

When the start switch 29 is moved to a position "OFF2", the change-over switch B15 will be connected to the equalizer B2, so that the digital data D1 generated in the equalizer B2 is outputted through the change-over switch B15 and the variable amplifier B16, thereby producing a musical sound without being processed to any extent.

On the other hand, when the start switch 29 is moved to a position "OFF3", the change-over switch B15 will be connected with the adder circuit B14, but only during a time when the switch 29 is being moved towards the position "OFF 3", thereby producing a musical sound processed to a predetermined extent. However, once the hand of a human operator leaves the start switch 29, the switch 29 will return back to the position "OFF 2" due to its own reaction force, thereby producing a musical sound without being processed to any extent.

An operating button 27 is called a mode-change button. Once the button 27 is operated to be set in its ON state, the BPM measuring section B3 is started. In this way, signal level change of the digital data D1 generated in the equalizer B2 is detected and a plurality of the level changes are counted by a program timer, so as to automatically measure BPM (Beats Per Minute) of a musical sound. Further, by dividing 60 seconds with BPM it is allowed to obtain a period $T_{BPM}$ necessary for one beat to occur and disappear. For example, if an automatically measured BPM is 120 and if 60 seconds is divided by the BPM 120, a result of 500 mSec may be obtained which may be used as a beat period $T_{BPM}$. In this way, the automatically measured BPM and the beat period $T_{BPM}$ may be respectively indicated on the BPM indicator 11 and the $T_{BPM}$ indicator 12.

Moreover, a $T_{BPM}$ setting section 100 provided in the system controller A1 supplies a beat period signal BT (indicating a beat period $T_{BPM}$) to the processing sections B4–B8, thereby enabling the processing sections B4–B8 to perform predetermined process in synchronism with a beat period $T_{BPM}$.

On the other hand, when the mode change-over button 27 is operated to be set in its OFF state, the operation of the BPM measuring section B3 will be stopped. Then, the system controller A1 may detect BPM' designated by a tap button 28. Namely, once the mode change-over button 27 is operated to be set in its OFF state and the tap button 28 is pushed down by tapping thereon, the system controller A1 will operate to measure BPM' (number of taps per minute). Further, by dividing 60 seconds with BPM' it is allowed to obtain a beat period $T_{BPM}'$ necessary for one tap to begin and end. In this way, the BPM' and the $T_{BPM}'$ may be respectively indicated on the BPM indicator 11 and the $T_{BPM}$ indicator 12.

Then, a $T_{BPM}$ setting section 100 provided in the system controller A1 supplies a period signal BT (indicating a period $T_{BPM}'$) to the processing sections B4–B8, thereby enabling the processing sections B4–B8 to perform predetermined process in synchronism with a period $T_{BPM}$. As a result, it is possible to produce a musical sound having a performance effect coincident with the rhythm (tempo) set by operating the tap button 28.

In this way, with the use of the mode change-over button 27, it is allowed to perform a change-over between the automatic mode capable of automatically setting BPM and $T_{BPM}$ for a musical sound and a manual mode capable manually setting BPM' and $T_{BPM}'$ for a musical sound (by operating the tap button 28). Therefore, the processing sections B4–B8 are enabled to perform their predetermined operations in synchronism with the period $T_{BPM}'$ (different from $T_{BPM}$ which is an original beat period of a musical sound), thereby producing a desired beat performance effect changing the rhythm (tempo) of a musical sound in a desired manner.

Operating buttons 21–26 are called magnification designating buttons which are used to set periods $T_{BPM}$ and $T_{BPM}'$ set by the automatic mode or the manual mode, with magnifications of 1/4, 1/2, 3/4, 1/1, 2/1, 4/1. For instance, when the magnification button 21 is operated to be set in its ON state, this operation will be detected by the system controller A1, so that the Period $T_{BPM}$ or the period $T_{BPM}'$ set by the automatic mode or the manual mode may be changed to $T_{BPM}/4$ or $T_{BPM}'/4$. Then, the periods $T_{BPM}/4$ or $T_{BPM}'/4$ are indicated on the $T_{BPM}$ indicator 12. In addition, a further tempo BPM", which is obtained by dividing 60 seconds with $T_{BPM}/4$ or $T_{BPM}'/4$, is indicated on the BPM indicator 11.

Then, a $T_{BPM}$ setting section 100 provided in the system controller A1 supplies a period signal BT (indicating a period $T_{BPM}/4$ or $T_{BPM}'/4$) to the processing sections B4–B8, thereby enabling the processing sections B4–B8 to perform predetermined process in synchronism with a period $T_{BPM}/4$ or $T_{BPM}'/4$.

In this way, under a condition where the mode change-over button 27 has been set in its ON state, once the magnification button 21 is pushed ON, it is sure to produce a musical sound having a tempo which is coincident with 1/4 of a tempo of an original musical sound. On the other hand, under a condition where the mode change-over button 27 has been set in its OFF state, once the magnification button 21 is pushed ON, it is sure to produce a musical sound having a tempo which is coincident with 1/4 of a tempo set by operating the tap button 28.

The operation of each of the magnification buttons 22–26 can produce a similar effect to that obtainable by the magnification button 21, thereby producing an effect of changing the tempo of a musical sound.

An adjusting knob 30 is provided to perform a fine adjustment on the magnifications (for determining beat period) set by the magnification buttons 21–26. When the knob 30 is rotated, its rotating amount will be detected by the system controller A1 which will then perform a fine adjustment on a beat period set by any one of the magnification designating buttons 21–26. In this way, a beat period and a tempo newly adjusted in said fine adjustment are respectively indicated on the BPM indicator 11 and the $T_{BPM}$ indicator 12, thereby enabling each of the processing sections B4–B8 to operate in synchronism with the newly adjusted beat period.

In this way, by operating the mode change-over button 27, the tap button 28, magnification buttons 21–26 and the adjusting button 30, it is allowed to set various desired performances (having different beat effects).

In particular, since a BPM (Beats Per Minute) and a beat period may be set automatically only by operating the magnification buttons 21–26, it is sure to quickly change the tempo of a musical sound, thereby improving the operability of the audio signal processing apparatus.

Light emitting elements 33–39 are provided to indicate the magnifications of beat periods finely adjusted by the adjusting knob 30. For example, when a magnification of a beat period finely adjusted by the adjusting knob 30 is between 1/4 and 1/2, the light emitting element 34 will be lightened. Similarly, each of remaining light emitting elements 33, 35–39 will also be lightened when a magnification of a beat period has deviated from a value pre-set in advance by one of the magnification designating buttons 22–26.

In this way, by virtue of the light emitting elements 33–39, it is sure to allow a human operator to quickly understand a magnification of a beat period, to thereby easily perform a fine adjustment on such magnification by operating the knob 30.

Figure 4:
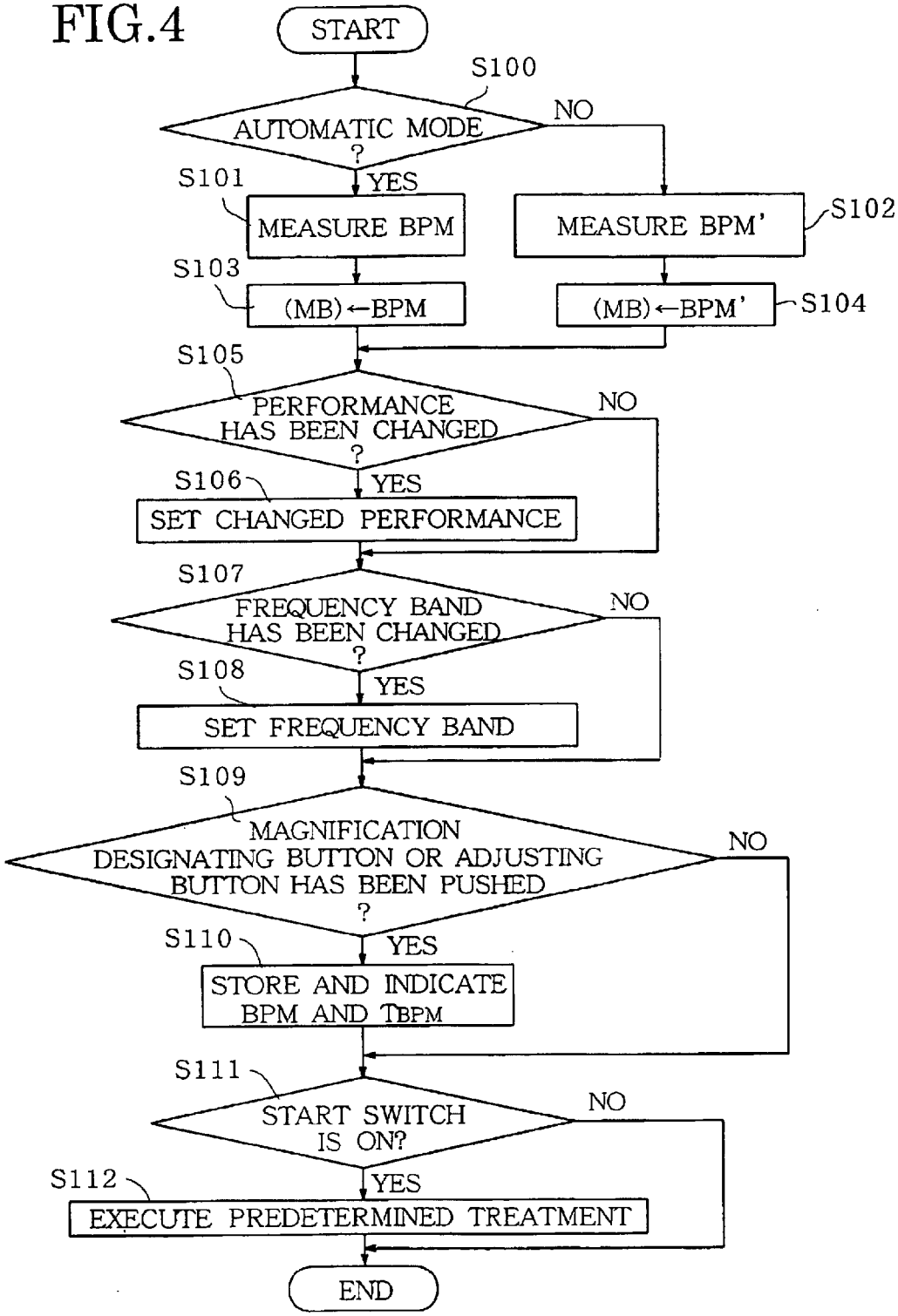
FIG. 4 is a flow chart indicating a procedure for an operation of the audio signal processing apparatus of the present invention.

An operation of the audio signal processing apparatus having the above-discussed constitution will be described in the following with reference to a flow chart shown in FIG. 4.

At a step S100, it is determined whether the automatic mode or the manual mode has been designated. If it is determined at the step S100 that the automatic mode has been designated, the program goes to a step S101 to automatically detect BPM (Beats Per Minute) from the digital data D1 having a tempo which is the same as that of an original musical sound. Then, at a step S103, a beat period $T_{BPM}$ is calculated in accordance with the BPM, followed by storing the BPM and $T_{BPM}$ in the storing section A4 and meanwhile indicating the same on the BPM indicator 11 and $T_{BPM}$ indicator 12.

On the other hand, if it is determined at a step S100 that the manual mode, rather than the automatic mode, has been designated, the program goes to a step 102 which is provided to measure a push-down period necessary for the tap button 28 to be pushed down, thereby obtaining a BPM' in accordance with the push-down period. Further, a period $T_{BPM}'$ is calculated in accordance with the BPM', followed by storing the BPM' and $T_{BPM}'$ in the storing section A4 and meanwhile indicating the same at the BPM indicator 11 and $T_{BPM}$ indicator 12.

Then, at a step S105, it is determined whether a performance has been changed by operating one of the operating buttons 13–17. If it is determined at the step S105 that a performance has been changed, the changed performance is set at a step S106. On the other hand, if it is determined at the step S105 that a performance has not been changed, there is no treatment to be effected at the step S106.

Subsequently, at a step S107 it is determined whether the frequency band of a Passing frequency component has been changed by operating one of the operating switches 18–20. If an answer is YES, the frequency band of the passing frequency component is set at a step S108. If an answer is NO, there is no treatment to be effected at the step S108.

Then, at the step S109, it is determined whether any one of the magnification buttons 21–26 or the adjusting knob 30 has been operated. If an answer is YES, the program goes to a step S110 at which BPM (Beats Per Minute) and a beat period are stored and indicated on the BPM indicator 11 and $T_{BPM}$ indicator 12. On the other hand, if it is determined neither magnification buttons 21–26 nor the adjusting knob 30 has been operated, there would be no treatment to be effected at the step S110.

Then, at a step S111 it is determined whether the start switch 29 has been set in its ON state. If an answer is YES, the program goes to a step S112 at which a predetermined treatment is effected. On the other hand, if an answer is NO, there would be no treatment to be effected. In this way, by repeating the steps S110–S112, a desired performance treatment may be carried out in accordance with a human operator's instruction.

In this way, with the use of the audio signal processing apparatus according to the present invention, by only operating the magnification buttons 21–26, it is allowed to easily set a desired beat period and a desired BPM (Beats Per Minute), thereby ensuring an improved operability for the apparatus.

While the presently preferred embodiments of the this invention have been shown and described above, it is to be understood that these disclosures are for the purpose of illustration and that various changes and modifications may be made without departing from the scope of the invention as set forth in the appended claims.

What is claimed is:

1. An audio signal processing apparatus capable of changing the tempo of an input audio signal, said apparatus comprising:

magnification designating means for designating a plurality of different magnification increments, said different magnification increments being 1/n and n, wherein n is an integer;

means for automatically detecting beats per minute of the input audio signal or a beat period of the input audio signal, changing said beats per minute or said beat period by applying to the detected beats per minute or the detected beat period a magnification increment designated by the magnification designating means, and changing the tempo of the input audio signal in accordance with the changed beats per minute or the changed beat period.

2. An audio signal processing apparatus according to claim 1, wherein manual designating means is provided for designating any optional value serving as a BPM and a beat period.

3. An audio signal processing apparatus according to claim 1, wherein fine adjustment means is provided to effect a fine adjustment on a BPM and a beat period.

4. An audio signal processing apparatus according to claim 1, wherein indicators are provided to indicate a BPM and a beat period.

5. An audio signal processing apparatus according to claim 1, wherein mixer is provided such that an audio signal generated by changing the tempo of said audio signal may be mixed with said input audio signal, thereby producing a newly formed audio signal.

6. An audio signal processing apparatus according to claim 5, wherein mixing ratio adjusting means is provided to adjust a mixing ratio when an audio signal generated by changing the tempo of said audio signal is mixed with said input audio signal, thereby producing a newly formed audio signal.

7. An audio signal processing apparatus according to claim 1, wherein the input audio signal comprises an analog signal, the analog signal is converted into a digital signal, a signal level changing period of the digital signal is detected, and a plurality of level changing periods are automatically counted so as to automatically measure a BPM of the input audio signal.

8. An audio signal as recited in claim 1, wherein said plurality of different magnification increments are even multiples or even divisions of the detected beats per minute of the input audio signal.

9. An audio signal as recited in claim 8, wherein said plurality of different magnification increments include 1/4, 1/2, 3/4, 1/1, 2/1, and 4/1.

10. An audio signal as recited in claim 8, wherein said plurality of different magnification increments automatically produce the changed tempo such that the changed tempo is synchronizable with the input audio signal.

11. An audio signal as recited in claim 1, wherein said beats per minute or said beat period is changed automatically based on the automatically detected beats per minute or a beat period of the input audio signal and the magnification increment designated.

12. An audio signal processing apparatus which changes the tempo of an input audio signal, said apparatus comprising:

a magnification designating device which designates a plurality of different magnification increments, said different magnification increments being 1/n and n, wherein n is an integer;

a device which automatically detects beats per minute of the input audio signal or a beat period of the input audio signal, changes said beats per minute or said beat period by applying to the detected beats per minute or the detected beat period a magnification increment designated by the magnification designating device, and changes the tempo of the input audio signal in accordance with the changed beats per minute or the changed beat period.

13. An audio signal as recited in claim 12, wherein said plurality of different magnification increments are even multiples or even divisions of the detected beats per minute of the input audio signal.

14. An audio signal as recited in claim 13, wherein said plurality of different magnification increments include 1/4, 1/2, 3/4, 1/1, 2/1, and 4/1.

15. An audio signal as recited in claim 13, wherein said plurality of different magnification increments automatically produce the changed tempo such that the changed tempo is synchronizable with the input audio signal.

16. An audio signal as recited in claim 12, wherein said beats per minute or said beat period is changed automatically based on the automatically detected beats per minute or a beat period of the input audio signal and the magnification increment designated.

17. An audio signal processing apparatus capable of changing the tempo of an input audio signal, said apparatus comprising:

magnification designating means for designating a plurality of different multiplication factors; and means for automatically detecting beats per minute of the input audio signal or a beat period of the input audio signal, changing said beats per minute or said beat period by multiplying the detected beats per minute or the detected beat period by a multiplication factor designated by the magnification designating means, and changing the tempo of the input audio signal in accordance with the changed beats per minute or the changed beat period.

18. An audio signal processing apparatus according to claim 17, wherein said different multiplication factors being at least one of 1/n and n, wherein n is an integer not equal to 1.

19. An audio signal processing apparatus according to claim 17, further comprising:

manual designating means for designating any optional value serving as a BPM and a beat period.

20. An audio signal processing apparatus according to claim 17, further comprising:

fine adjustment means for effecting a fine adjustment on a BPM and a beat period.

21. An audio signal processing apparatus according to claim 17, further comprising:

indicators indicating a BPM and a beat period.

22. An audio signal processing apparatus according to claim 17, further comprising:

mixer means for mixing an audio signal generated by changing the tempo of said audio signal with said input audio signal, thereby producing a newly formed audio signal.

23. An audio signal processing apparatus according to claim 22, further comprising:

mixing ratio adjusting means for adjusting a mixing ratio when an audio signal generated by changing the tempo of said audio signal is mixed with said input audio signal, thereby producing a newly formed audio signal.

24. An audio signal processing apparatus according to claim 17, wherein the input audio signal comprises an analog signal, the analog signal is converted into a digital signal, a signal level changing period of the digital signal is detected, and a plurality of level changing periods are automatically counted so as to automatically measure a BPM of the input audio signal.

25. An audio signal as recited in claim 17, wherein said plurality of different multiplication factors are even multiples or even divisions of the detected beats per minute of the input audio signal.

26. An audio signal as recited in claim 25, wherein said plurality of different multiplication factors include 1/4, 1/2, 3/4, 2/1, and 4/1.

27. An audio signal as recited in claim 25, wherein said plurality of different multiplication factors automatically produce the changed tempo such that the changed tempo is synchronizable with the input audio signal.

28. An audio signal as recited in claim 17, wherein said beats per minute or said beat period is changed automatically based on the automatically detected beats per minute or a beat period of the input audio signal and the multiplication factor designated.

29. An audio signal processing apparatus which changes the tempo of an input audio signal, said apparatus comprising:

a magnification designating device which designates a plurality of different multiplication factors; and a device which automatically detects beats per minute of the input audio signal or a beat period of the input audio signal, changes said beats per minute or said beat period by multiplying the detected beats per minute or the detected beat period by a multiplication factor designated by the magnification designating device, and changes the tempo of the input audio signal in accordance with the changed beats per minute or the changed beat period.

30. An audio signal processing apparatus according to claim 29, wherein said different multiplication factor is at least one of 1/n and n, wherein n is an integer not equal to 1.

31. An audio signal as recited in claim 29, wherein said plurality of different multiplication factors are even multiples or even divisions of the detected beats per minute of the input audio signal.

32. An audio signal as recited in claim 31, wherein said plurality of different multiplication factors include 1/4, 1/2, 3/4, 2/1, and 4/1.

33. An audio signal as recited in claim 31, wherein said plurality of different multiplication factors automatically produce the changed tempo such that the changed tempo is synchronizable with the input audio signal.

34. An audio signal as recited in claim 29, wherein said beats per minute or said beat period is changed automatically based on the automatically detected beats per minute or a beat period of the input audio signal and the multiplication factor designated.

35. An audio signal as recited in claim 34, wherein said plurality of different magnification increments include 1/4, 1/2, and 3/4.

36. An audio signal processing apparatus capable of changing the tempo of an input audio signal, said apparatus comprising:

magnification designating means for designating a plurality of different magnification increments, said different magnification increments being at least 1/n, wherein n is an integer not equal to 1;

means for automatically detecting beats per minute of the input audio signal or a beat period of the input audio signal, changing said beats per minute or said beat period by applying to the detected beats per minute or the detected beat period a magnification increment designated by the magnification designating means, and changing the tempo of the input audio signal in accordance with the changed beats per minute or the changed beat period.

37. An audio signal processing apparatus according to claim 36, further comprising:

a manual designating means for designating any optional value serving as a BPM and a beat period.

38. An audio signal processing apparatus according to claim 36, further comprising:

a fine adjustment means for effecting a fine adjustment on a BPM and a beat period.

39. An audio signal processing apparatus according to claim 36, further comprising:

indicators to indicate a BPM and a beat period.

40. An audio signal processing apparatus according to claim 36, further comprising:

a mixer means for mixing an audio signal generated by changing the tempo of said audio signal with said input audio signal, thereby producing a newly formed audio signal.

41. An audio signal processing apparatus according to claim 40, further comprising:

a mixing ratio adjusting means for adjusting a mixing ratio when an audio signal generated by changing the tempo of said audio signal is mixed with said input audio signal, thereby producing a newly formed audio signal.

42. An audio signal processing apparatus according to claim 36, wherein the input audio signal comprises an analog signal, the analog signal is converted into a digital signal, a signal level changing period of the digital signal is detected, and a plurality of level changing periods are automatically counted so as to automatically measure a BPM of the input audio signal.

43. An audio signal as recited in claim 36, wherein said plurality of different magnification increments are even divisions of the detected beats per minute of the input audio signal.

44. An audio signal as recited in claim 43, wherein said plurality of different magnification increments automatically produce the changed tempo such that the changed tempo is synchronizable with the input audio signal.

45. An audio signal as recited in claim 36, wherein said beats per minute or said beat period is changed automatically based on the automatically detected beats per minute or a beat period of the input audio signal and the magnification increment designated.

46. An audio signal processing apparatus which changes the tempo of an input audio signal, said apparatus comprising:

a magnification designating device which designates a plurality of different magnification increments, said different magnification increments being at least 1/n, wherein n is an integer not equal to 1;

a device which automatically detects beats per minute of the input audio signal or a beat period of the input audio signal, changes said beats per minute or said beat period by applying to the detected beats per minute or the detected beat period a magnification increment designated by the magnification designating device, and changes the tempo of the input audio signal in accordance with the changed beats per minute or the changed beat period.

47. An audio signal as recited in claim 46, wherein said plurality of different magnification increments are even divisions of the detected beats per minute of the input audio signal.

48. An audio signal as recited in claim 47, wherein said plurality of different magnification increments include 1/4, 1/2 and 3/4.

49. An audio signal as recited in claim 47, wherein said plurality of different magnification increments automatically produce the changed tempo such that the changed tempo is synchronizable with the input audio signal.

50. An audio signal as recited in claim 46, wherein said beats per minute or said beat period is changed automatically based on the automatically detected beats per minute or a beat period of the input audio signal and the magnification increment designated.

* * * * *